United States Patent [19]

Anderson et al.

[11] Patent Number: 5,037,338

[45] Date of Patent: Aug. 6, 1991

[54] MARINE PROPULSION DEVICE TILT LIMIT SWITCH

[75] Inventors: Philip A. Anderson, Waukegan; Gregory J. Binversie, Grayslake; John M. Daniels, Round Lake Park, all of Ill.

[73] Assignee: Outboard Marine Corporation, Waukegan, Ill.

[21] Appl. No.: 525,914

[22] Filed: May 18, 1990

Related U.S. Application Data

[63] Continuation-in-part of Ser. No. 407,916, Sep. 15, 1989, abandoned.

[51] Int. Cl.[5] ..... B63H 5/12

[52] U.S. Cl. ..... 440/61; 440/1

[58] Field of Search ..... 440/1, 2, 53, 61–63, 440/900; 340/689; 92/5 R, 13.135; 114/275, 284–286; 91/392; 200/52 R, 61.41, 61.44, 573, 574

[56] References Cited

U.S. PATENT DOCUMENTS

| | | | |
|---|---|---|---|
| 3,641,965 | 2/1972 | Schmiedel | 440/2 |
| 3,834,345 | 9/1974 | Hager et al. | 440/61 |
| 3,841,257 | 10/1974 | Strang | 440/63 |
| 4,005,674 | 2/1977 | Davis | 440/2 |
| 4,605,375 | 8/1986 | Ferguson | 440/1 |
| 4,682,961 | 7/1987 | Nakahama | 440/63 |
| 4,695,260 | 9/1987 | Suzuki et al. | 440/61 |
| 4,778,414 | 10/1988 | Taguchi | 440/1 |
| 4,861,291 | 8/1989 | Koike | 440/1 |

FOREIGN PATENT DOCUMENTS 1311453 8/1983 United Kingdom .

*Primary Examiner*—Ed Swinehart

*Attorney, Agent, or Firm*—Michael, Best & Friedrich

[57] ABSTRACT

A marine propulsion device comprising a transom bracket adapted to be affixedly mounted on the transom of a boat, a propulsion unit mounted on the transom bracket for pivotal movement relative thereto about a generally horizontal tilt axis, an extendable and contractable link connected between the transom bracket and the propulsion unit for pivoting the propulsion unit about the tilt axis, and a mechanism for stopping pivotal movement of the propulsion unit in response to the position of the link relative to the propulsion unit.

48 Claims, 4 Drawing Sheets

230
204
234
9

230
226
204
234
206
18
19
10
218
214

210
218
204
218
214
206
222
10

230
234
204
206
214
104
19
108
16

34

MARINE PROPULSION DEVICE TILT LIMIT SWITCH

This is a continuation-in-part of co-pending Ser. No. 407,916, filed Sept. 15, 1989, now abandoned.

BACKGROUND OF THE INVENTION

The invention relates to marine propulsion devices, and, more particularly, to means for limiting the upward tilting movement of the propulsion unit of a marine propulsion device.

A typical propulsion device, such as an outboard motor, includes a propulsion unit mounted on the transom of a boat for pivotal movement relative thereto about a generally horizontal tilt axis. In many cases, pivotal movement of the propulsion unit is controlled by a hydraulic cylinder-piston assembly extending between a mounting bracket fixed to the transom and either the propulsion unit or a swivel bracket. Hydraulic fluid is selectively supplied to the opposite ends of the cylinder by a pump.

Because of the wide variety of boat and outboard motor combinations now possible, it is fairly common to have interference between the boat and the propulsion unit of the outboard motor when the propulsion unit is in its maximum upward tilt position. This can result in damage to the boat and/or the outboard motor.

It is known to provide a switch for disabling the pump when the propulsion unit reaches the upper limit of its pivotal movement. U.S. Pat. No. 4,695,260 teaches the use of either a pressure responsive switch in the hydraulic pressure line or a limit switch for sensing when the hydraulic assembly is fully extended.

Attention is also directed to Ferguson U.S. Pat. No. 4,605,375, issued Aug. 12, 1986.

SUMMARY OF THE INVENTION

The invention provides a marine propulsion device comprising a transom bracket adapted to be fixedly mounted on the transom of a boat, a propulsion unit mounted on the transom bracket for pivotal movement relative thereto about a generally horizontal tilt axis, an extendable and contractable link connected between the transom bracket and the propulsion unit for pivoting the propulsion unit about the tilt axis, and means for stopping pivotal movement of the propulsion unit in response to the position of the link relative to one of the transom bracket and the propulsion unit.

The invention also provides a marine propulsion device comprising a transom bracket adapted to be fixedly mounted on the transom of a boat, a propulsion unit mounted on the transom bracket for upward and downward pivotal movement relative thereto about a generally horizontal tilt axis, operator actuatable means for pivoting the propulsion unit about the tilt axis, and adjustable means operable independently of the operator actuatable means for stopping upward pivotal movement of the propulsion unit.

The invention also provides a marine propulsion device comprising a transom bracket adapted to be fixedly mounted on the transom of a boat, a propulsion unit mounted on the transom bracket for pivotal movement relative thereto about a generally horizontal tilt axis, means for pivoting the propulsion unit about the tilt axis, and means including a first member fixed relative to one of the transom bracket and the propulsion unit and a second member fixed relative to the pivoting means for stopping pivotal movement of the propulsion unit.

The invention also provides a marine propulsion device comprising a transom bracket adapted to be fixedly mounted on the transom of a boat, a pivot member which is supported by the transom bracket and which extends along a generally horizontal tilt axis, a propulsion unit mounted on the pivot member for pivotal movement relative thereto about the tilt axis, means for pivoting the propulsion unit about the tilt axis, and means including a first member fixed relative to the propulsion unit and a second member fixed relative to the pivot member for stopping pivotal movement of the propulsion unit.

A principal feature of the invention is the provision of a marine propulsion device comprising operator actuatable means for pivoting a propulsion unit about a tilt axis, and adjustable means operable independently of the operator actuatable means for stopping upward pivotal movement of the propulsion unit. This permits the maximum upward tilt position of the propulsion unit to be adjusted so that the marine propulsion device can be used with a variety of boat constructions.

Another principal feature of the invention is the provision of means for stopping upward pivotal movement of a propulsion unit in response to the position of the hydraulic cylinder-piston assembly relative to the propulsion unit.

Another principal feature of the invention is the provision of means for stopping upward pivotal movement of the propulsion unit when the tilt cylinder reaches a predetermined angle relative to the propulsion unit.

Another principal feature of the invention is the provision of a member fixed to the hydraulic assembly, a member fixed to the propulsion unit, and means for stopping upward pivotal movement of the propulsion unit when the members engage. This arrangement solves the problem of having little space for mounting a limit switch between the mounting bracket and the propulsion unit or swivel bracket.

Other features and advantages of the invention will become apparent to those skilled in the art upon review of the following detailed description, claims and drawings.

Figure 1:
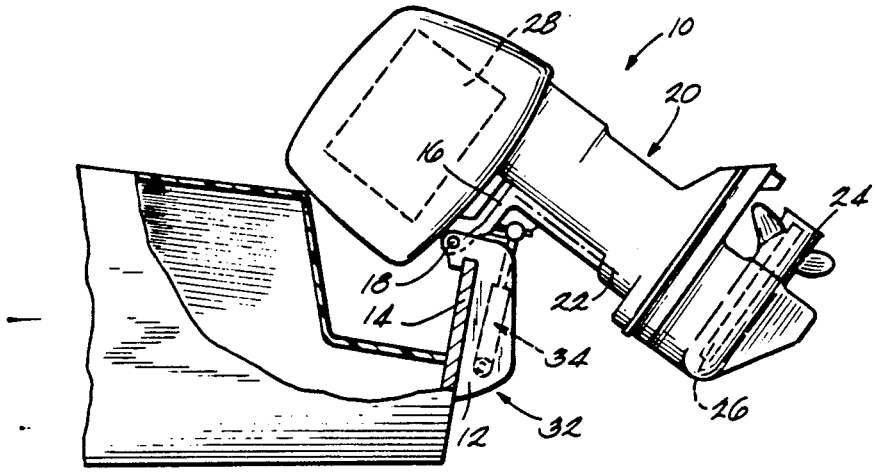
FIG. 1 is a side elevational view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in FIGS. 1-6. While the illustrated marine propulsion device is an outboard motor, it should be understood that the invention is applicable to other types of marine propulsion devices, such as stern drive units.

The marine propulsion device 10 comprises (see FIG. 1) a transom bracket 12 fixedly mounted on the transom 14 of a boat. The marine propulsion device 10 also comprises (see FIGS. 1-3) a swivel bracket 16 mounted on the transom bracket 12 for upward and downward pivotal movement relative thereto about a generally horizontal tilt axis 18. In the preferred embodiment, the marine propulsion device 10 further comprises a pivot member or tilt tube 19 which is supported by the transom bracket 12 and which extends along the tilt axis 18. The swivel bracket 16 is mounted on the tilt tube 19 for pivotal movement relative thereto about the tilt axis 18. The marine propulsion device 10 further comprises (see FIG. 1) a propulsion unit 20 mounted on the swivel bracket 16 for pivotal movement relative thereto about a generally vertical steering axis 22 and for common pivotal movement therewith about the tilt axis 18. The propulsion unit 20 includes a propeller 24 fixedly mounted on a propeller shaft 26, and an engine 28 drivingly connected to the propeller shaft 26 via a conventional drive train (not shown).

Figure 5:
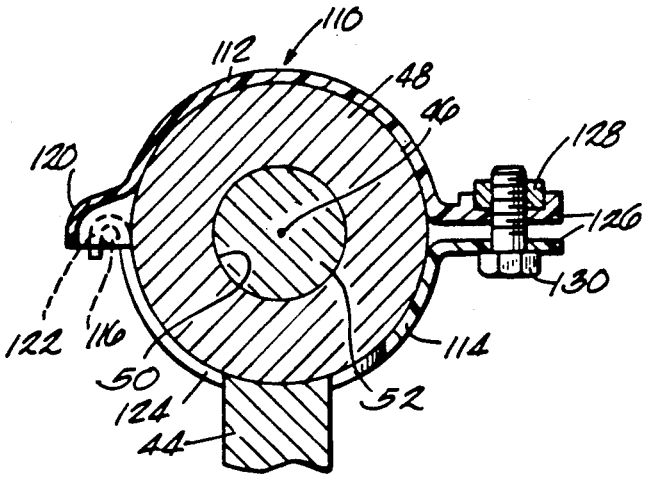
FIG. 5 is a view taken along line 5—5 in FIG. 4.

The marine propulsion device 10 further comprises (see FIGS. 1 and 6) operator actuatable means 32 for pivoting the propulsion unit 20 about the tilt axis 18. Preferably, the means 32 includes an extendable and contractable link connected between the boat and the propulsion unit 20. In the preferred embodiment, the link is a hydraulic cylinder-piston assembly 34 including (see FIG. 6) a cylinder 36 pivotally connected to the transom bracket 12, a piston 38 slidably housed in the cylinder 36 so as to divide the cylinder into upper and lower chambers 40 and 42, respectively, and a piston rod 44 fixedly connected to the piston 38 and connected to the swivel bracket 16 for pivotal movement relative thereto about an axis 46 (FIG. 5). The piston 38 has therein a relief valve (not shown) that permits fluid flow from the upper chamber 40 to the lower chamber 42 and thereby permits extension of the cylinder-piston assembly 34 in the event the marine propulsion device 10 strikes an underwater obstacle. The upper end of the piston rod 44 has thereon (see FIGS. 2-5) an eyelet 48 having therethrough a horizontally extending bore 50 (FIG. 5), and the piston rod 44 is pivotally connected to the swivel bracket 16 by a pin 52 which extends through the bore 50 and which is fixedly connected to the swivel bracket 16. Extension of the hydraulic assembly 34 causes upward pivotal movement of the propulsion unit 20 and contraction of the hydraulic assembly 34 causes downward pivotal movement of the propulsion unit 20.

The operator actuatable means 32 also includes (see FIG. 6) a reversible pump 54 connected to the cylinder chambers 40 and 42 via hydraulic conduits 56 and 58, respectively. Conventional relief valves 60 and 62 connect the conduits 56 and 58 in order to permit fluid flow between the conduits 56 and 58 when the piston 38 tops out or bottoms out. The operator actuatable means 32 also includes an electric motor 64 drivingly connected to the pump 54. The direction in which the motor 64 drives the pump 54 is determined by the direction in which current flows through the motor 64. More particularly, the motor 64 has two leads or contacts 66 and 68, and the motor 64 drives the pump 54 in one direction when the lead 66 is connected to a source of electric power and drives the pump 54 in the other direction when the lead 68 is connected to a source of electric power. The pump 54 and motor 64 are conventional and will not be described in further detail.

Figure 6:
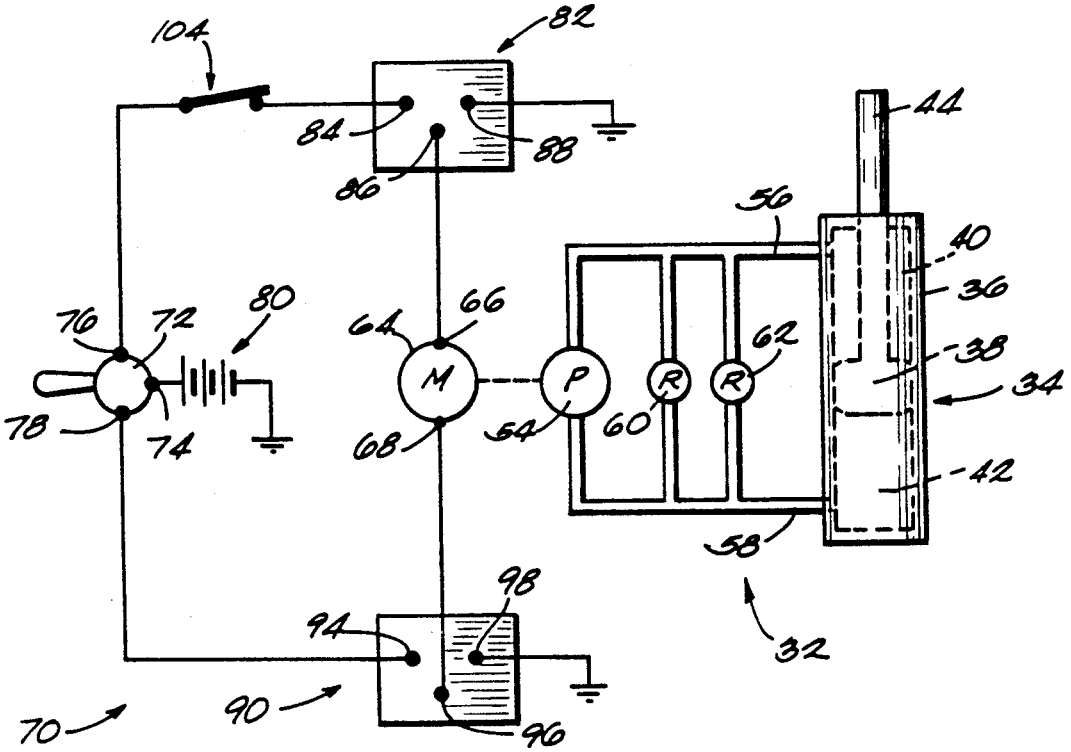
FIG. 6 is a schematic view of the electrical and hydraulic circuits of the marine propulsion device.

The operator actuatable means 32 also includes (see FIG. 6) an electrical circuit 70 permitting selective operator actuation of the motor 64. The circuit 70 includes a manually operable three-position switch 72 having three leads 74, 76 and 78. The middle lead 74 is connected to a suitable source of electric power, such as a battery 80 for the marine propulsion device 10. When the switch 72 is in its middle or "off" position, the battery 80 is connected to neither of the leads 76 and 78. When the switch 72 is in its second or "up" position, the battery 80 is connected to the lead 76. When the switch 72 is in its third or "down" position, the battery 80 is connected to the lead 78. The circuit 70 also includes an "up" relay 82 having three leads 84, 86 and 88. The relay 82 operates to connect the lead 84 to the lead 86 when the lead 84 is connected to a source of electrical power, and operates to connect the lead 86 to the lead 88 when the lead 86 is connected to a source of electrical power. As shown in FIG. 6, the lead 84 is connected to the lead 76 of the switch 72, the lead 86 is connected to the lead 66 of the motor 64, and the lead 88 is connected to ground. The electrical circuit 70 also includes a "down" relay 90 that is substantially identical to the "up" relay 82 and that includes leads 94, 96 and 98 respectively corresponding to the leads 84, 86 and 88 of the "up" relay 82. The lead 94 is connected to the lead 78 of the switch 72, the lead 96 is connected to the lead 68 of the motor 64, and the lead 98 is connected to ground.

The electrical circuit 70 operates as follows. When the switch 72 is in its "off" position, the motor 64 is disconnected from the battery 80 and does not drive the pump 54. When the switch 72 is in its "up" position, current flows from the battery 80 to the lead 66 of the motor 64 via the switch leads 74 and 76 and the "up" relay leads 84 and 86, and current flows from the motor lead 68 to ground via the "down" relay leads 96 and 98. This causes the motor 64 to drive the pump 54 in the direction providing fluid flow to the lower cylinder chamber 42. When the switch 72 is in its "down" position, current flows from the battery 80 to the motor lead 68 via the switch leads 74 and 78 and the "down" relay leads 94 and 96, and current flows from the motor lead 66 to ground via the "up" relay leads 86 and 88. This causes the motor 64 to drive the pump 54 in the direction causing fluid flow to the upper cylinder chamber 40.

Figure 2:
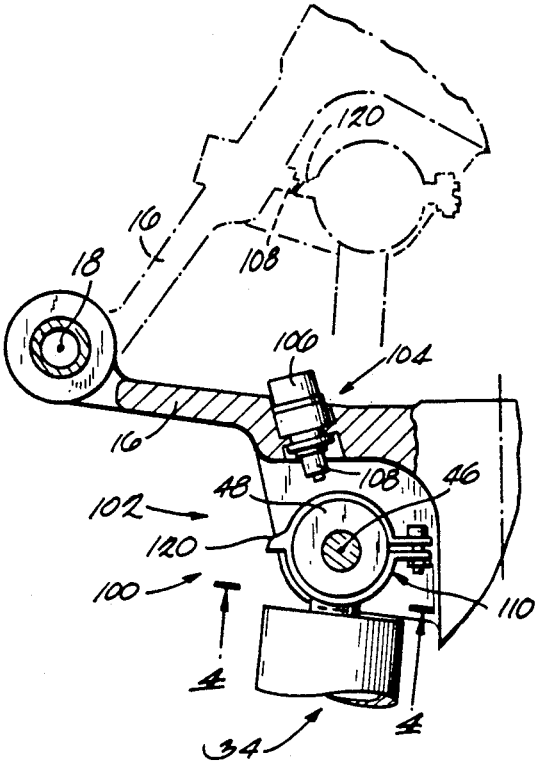
FIG. 2 is an enlarged, partial view of the marine propulsion device.
Figure 3:
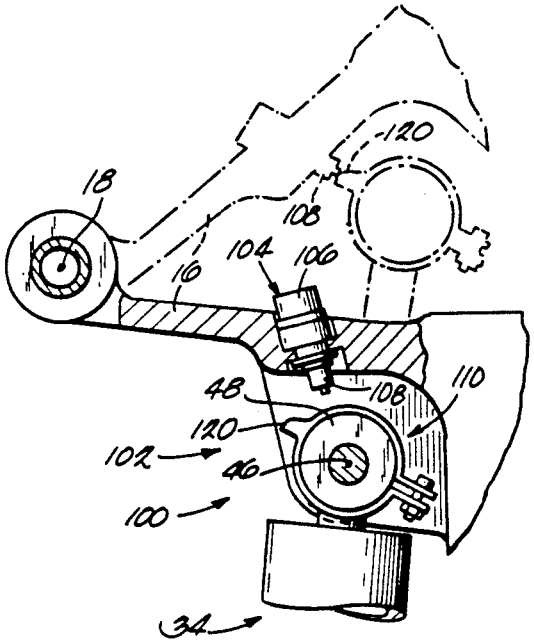
FIG. 3 is a view similar to FIG. 2.

The marine propulsion device 10 further comprises (see FIGS. 2-5) adjustable means 100 operable independently of the operator actuatable means 32 for stopping pivotal movement of the propulsion unit 20. In the illustrated construction, the means 100 includes means for stopping upward pivotal movement of the propulsion unit 20 in response to the position of the hydraulic assembly 34 relative to the swivel bracket 16 or propulsion unit 20. While various suitable means can be employed, in the illustrated embodiment, such means includes means 102 for stopping upward pivotal movement of the propulsion unit 20 when the hydraulic assembly 34 reaches a predetermined angle relative to the swivel bracket 16 or propulsion unit 20. While various suitable stopping means 102 can be used, in the illustrated construction, the means 102 includes (see FIGS. 2, 3 and 6) a first member or electrical switch 104 (shown schematically in FIG. 6) which is mounted on the swivel bracket 16 (and thus is fixed relative to the propulsion unit 20) and which is electrically connected to the motor 64 so that opening of the switch 104 disables the motor 64 and thereby disables the pump 54. More particularly, the switch 104 is biased closed and is connected in series between the switch lead 76 and the "up" relay lead 84, so that opening of the switch 104 prevents operation of the motor 64 to cause extension of the cylinder-piston assembly 34. As shown in FIGS. 2 and 3, the switch 104 includes a housing 106 fixedly mounted on the swivel bracket 16, and a plunger or button 108 axially movable relative to the housing 106 between an inward or open position (shown in phantom in FIGS. 2 and 3) and an outward or closed position (shown in solid lines in FIGS. 2 and 3). The plunger 108 is biased outwardly or toward the closed position. In alternative embodiments, the housing 106 can be mounted on the swivel bracket 16 such that the position of the housing 106 relative to the swivel bracket 16 can be adjusted. For example, the housing 106 can be translationally or axially movable relative to the swivel bracket 16.

Figure 4:
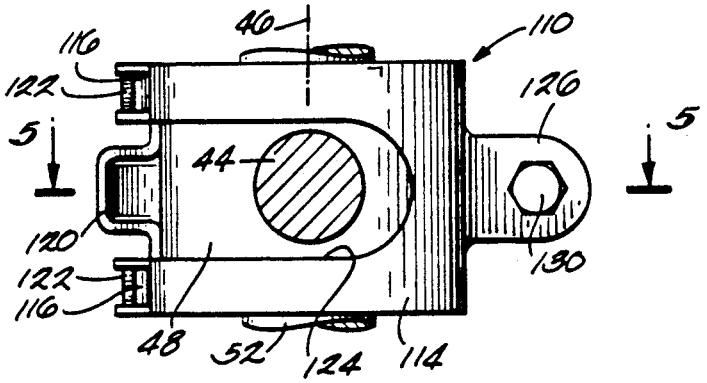
FIG. 4 is an enlarged view taken along line 4—4 in FIG. 2.

The stopping means 102 also includes (see FIGS. 2–5) a second member or switch actuator or cam member 110 mounted on the upper end of the piston rod 44. More particularly, as shown in FIGS. 4 and 5, the switch actuator 110 is a clamp-like structure having a generally C-shaped upper portion 112 and a generally C-shaped lower portion 114. The upper portion 112 has thereon a pair of spaced apart pins 116, and has thereon a projection or actuator 120 that is engageable with the plunger 108 so as to move the plunger 108 to the open position. The lower portion 114 has thereon a pair of spaced apart hooks 122 which receive the pins 116, and has therein a slot 124 through which the piston rod 44 extends. The upper and lower portions 112 and 114 have thereon respective rearwardly extending tabs 26 secured to each other by a nut 128 and a bolt 130. When the bolt 130 is loose, the switch actuator 110 is pivotable about the eyelet 48, or relative to the piston rod 44 about the axis 46, so that the orientation of the switch actuator 110 relative to the piston rod 44 is adjustable. When the bolt 130 is tightened, the switch actuator 110 is fixed in position relative to the piston rod 44. The opposite ends of the slot 124 limit pivotal movement of the switch actuator 110 relative to the eyelet 48.

As shown in FIGS. 2 and 3, the angle of the piston rod 44 relative to the swivel bracket 16, and therefore the angle of the switch actuator 110 relative to the swivel bracket 16, changes as the propulsion unit 20 pivots upwardly about the tilt axis 18. As the propulsion unit pivots upwardly, the projection 120 eventually engages the plunger 108 and opens the switch 104. The orientation of the switch actuator 110 relative to the piston rod 44 or eyelet 48 determines the position or angle of the propulsion unit 20 at which the projection 120 engages the plunger 108. In FIG. 2, the switch actuator 110 is shown oriented relative to the piston rod 44 such that the projection 120 engages the plunger 108 when the propulsion unit 20 has pivoted 75° from the vertical position. In FIG. 3, the switch actuator 110 is shown oriented such that the projection 120 engages the plunger 108 when the propulsion unit 20 has pivoted 50° from the vertical position. Thus, the upward tilting limit or maximum upward tilt angle of the propulsion unit 20 can be varied by varying the orientation of the switch actuator 110 relative to the piston rod 44.

In an alternative embodiment (not shown), the means 100 can stop upward movement of the propulsion unit 20 in response to the position of the hydraulic assembly 34 relative to the transom bracket 12. In this case, the means 102 would stop upward pivotal movement of the propulsion unit 20 when the hydraulic assembly 34 reaches a predetermined angle relative to the transom bracket 12. More particularly, the means 102 could include a switch mounted on the transom bracket 12 and a switch actuator mounted on the lower end of the cylinder 36. The switch and the switch actuator would operate in a manner similar to the manner in which the switch 104 and the switch actuator 110 operate.

A marine propulsion device 200 that is an alternative embodiment of the invention is illustrated in FIGS. 7–12. Except as described hereinafter, the marine propulsion device 200 is substantially identical to the marine propulsion device 10, and common elements have been given the same reference numerals.

In order to prevent axial movement of the tilt tube 19 relative to the transom bracket 12, the outboard motor 200 comprises a retaining member **201*a* fixed to one end of the tilt tube 19, and a retaining member 201*b* fixed to the other end of the tilt tube 19. In the illustrated construction, the retaining member 201*a* is welded to the tilt tube 19, and the retaining member 201*b* is threaded onto the tilt tube 19**.

The outboard motor 200 comprises means for preventing rotation of the tilt tube 19 relative to the transom bracket 12. While various suitable means can be employed, in the illustrated construction, such means includes (see FIG. 12) a slot 202 located in the transom bracket 12, and a key 203 which extends radially outwardly from the retaining member **201*a* and which is received in the slot 202. Since the retaining member 201*a* is fixed to the tilt tube 19, receipt of the key 203 in the slot 202 prevents pivotal movement of the tilt tube 19 relative to the transom bracket 12**.

In the outboard motor 200, the adjustable means 100 includes (see FIGS. 7–9) a first member or switch 104 mounted on the swivel bracket 16 (and thus fixed relative to the propulsion unit 20), an annular third member or switch actuator or cam member 204, and an annular second member or support member 206 mounted on the tilt tube 19. The support member 206 has thereon a radially extending post or projection 210, and a set screw 214 threaded into the projection 210 engages the tilt tube 19 and thereby fixes the position of the support member 206 relative to the tilt tube 19. The cam member 204 surrounds and is mounted on the support member 206 and has therein a circumferentially extending slot 218 that receives the projection 210 and that has opposite ends. Engagement of the projection 210 by the opposite ends of the slot 218 limits pivotal movement of the cam member 204 relative to the support member 206. The cam member 204 also has therein a slot 222 that communicates with the slot 218 and that receives the projection 210 on the support member 206 so as to permit the cam member 204 to be located in surrounding relation to the support member 206. The cam member 204 also has thereon a radially extending post or projection 226, and a set screw 230 threaded into the projection 226 releasably engages the support member 206 and thereby releasably fixes the position of the cam member 204 relative to the support member 206 and thus relative to the tilt tube 19. The cam member 204 further has thereon a projection or actuator 234 that is engageable with the plunger 108 so as to move the plunger 108 to the open position.

Figures 7, 8, 9, 10:
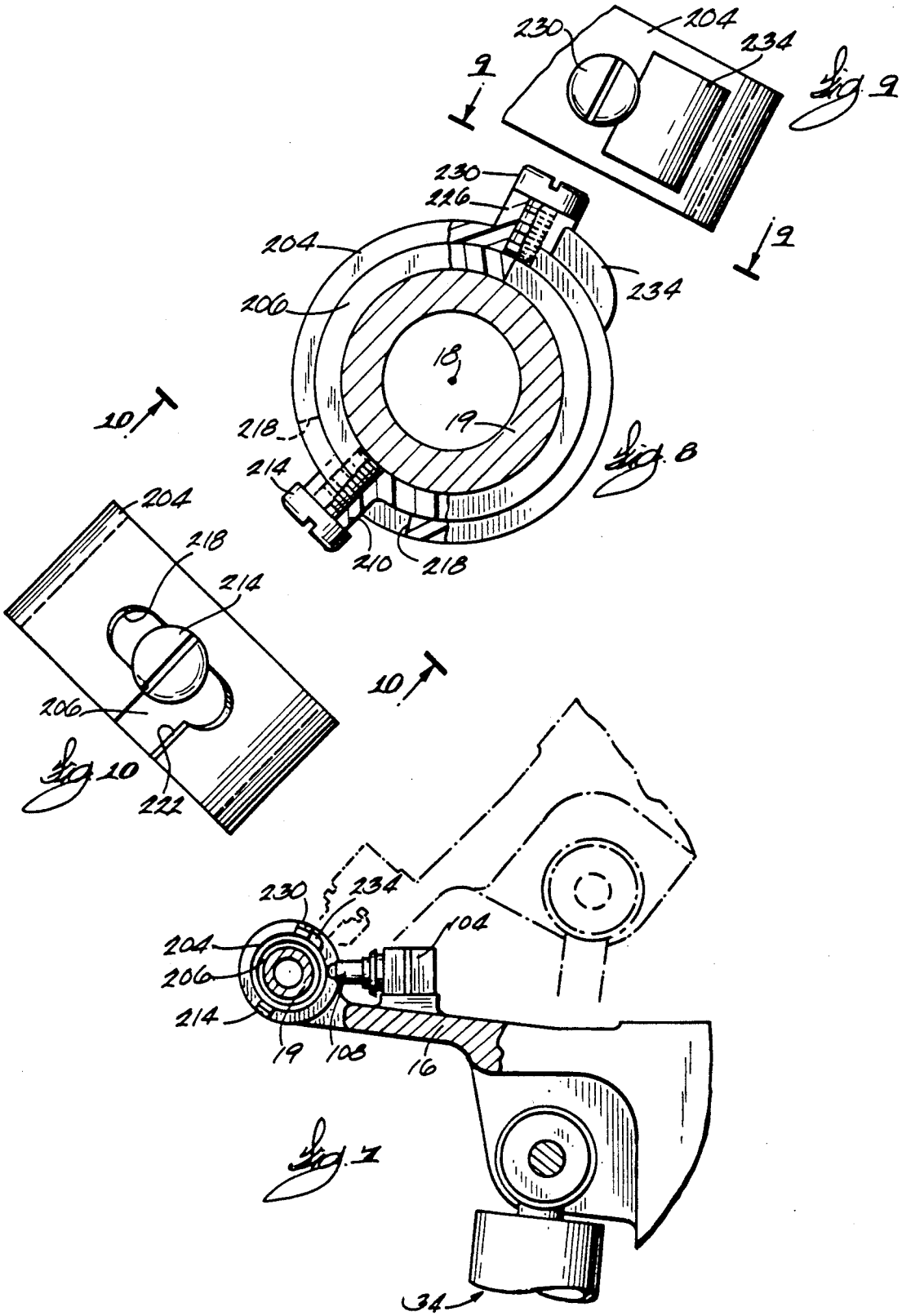
FIG. 7 is a view similar to FIG. 2 showing a marine propulsion device that is an alternative embodiment of the invention.
FIG. 8 is an enlarged, partial view of the marine propulsion device shown in FIG. 7.
FIG. 9 is a view taken along line 9—9 in FIG. 8.
FIG. 10 is a view taken along line 10—10 in FIG. 8.
Figure 11:
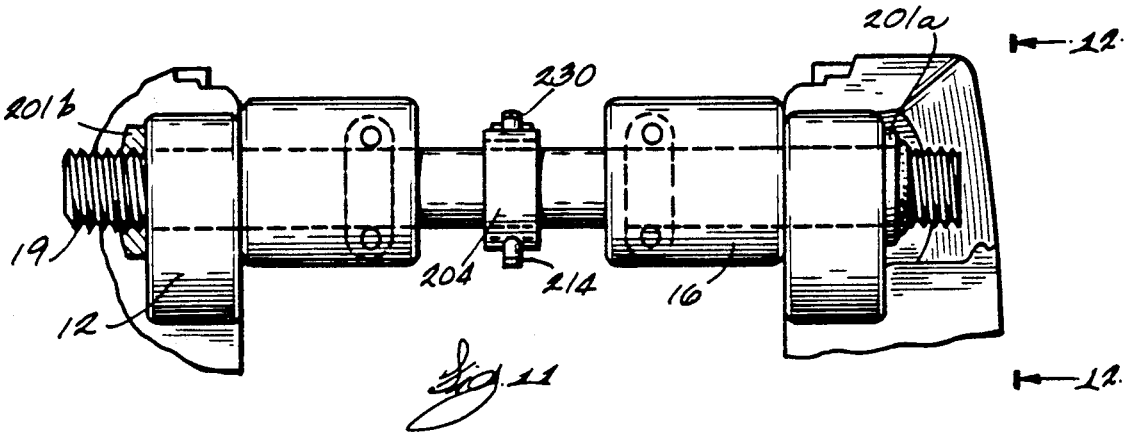
FIG. 11 is a partial front elevational view of the marine propulsion device shown in FIGS. 7-10.
Figure 12:
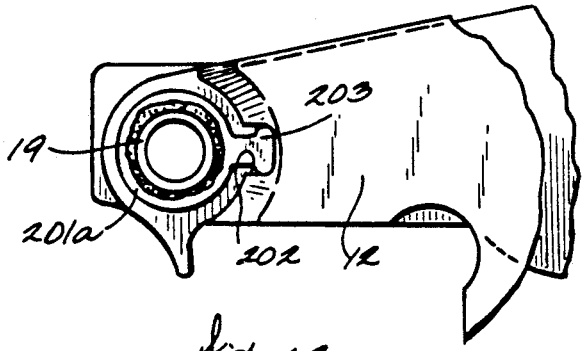
FIG. 12 is a view taken along line 12—12 in FIG. 11.

As shown in FIG. 7, the angle of the swivel bracket 16 relative to the tilt tube 19 changes as the propulsion unit 20 pivots upwardly about the tilt axis 18. As the propulsion unit 20 pivots upwardly, the projection 234 eventually engages the plunger 108 and opens the switch 104. The orientation of the cam member 204 relative to the support member 206 (and thus relative to the tilt tube 19) determines the angle of the propulsion unit 20 at which the projection 234 engages the plunger 108. Since the position or orientation of the cam member 204 relative to the tilt tube 19 is adjustable, the angle of the swivel bracket 16 relative to the transom bracket 12 at which the switch plunger 108 engages the projection 234 is adjustable.

Various features of the invention are set forth in the following claims.

We claim:

1. A marine propulsion device comprising a transom bracket adapted to be fixedly mounted on the transom of a boat, a propulsion unit mounted on said transom bracket for pivotal movement relative thereto about a generally horizontal tilt axis, an extendable and contractable cylinder-piston assembly connected between said transom bracket and said propulsion unit for pivoting said propulsion unit about said tilt axis in response to extension and contraction of said assembly, a pump for selectively and alternatively extending and contracting said assembly, and means for disabling said pump and thereby stopping pivotal movement of said propulsion unit in response to the position of said assembly relative to one of said transom bracket and said propulsion unit.

2. A marine propulsion device as set forth in claim 1 and further comprising a swivel bracket mounted on said transom bracket for pivotal movement relative thereto about said tilt axis, wherein said propulsion unit is mounted on said swivel bracket for pivotal movement relative thereto about a generally vertical steering axis and for common movement therewith about said tilt axis, and wherein said means stops said propulsion unit in response to the position of said assembly relative to said swivel bracket.

3. A marine propulsion device as set forth in claim 2 wherein said means includes a first member fixed relative to said swivel bracket and a second member fixed relative to said link.

4. A marine propulsion device as set forth in claim 3 wherein the position of said second member relative to said link is adjustable.

5. A marine propulsion device as set forth in claim 1 wherein said assembly has a first end pivotally connected to said transom bracket and a second end pivotally connected to said propulsion unit, and wherein said means stops pivotal movement of said propulsion unit when said assembly reaches a predetermined angle relative to said propulsion unit.

6. A marine propulsion device as set forth in claim 1 wherein said means includes a first member fixed relative to said propulsion unit and a second member fixed relative to said assembly.

7. A marine propulsion device as set forth in claim 6 wherein the position of said second member relative to said assembly is adjustable.

8. A marine propulsion device as set forth in claim 7 and further comprising means for limiting movement of said second member relative to said assembly.

9. A marine propulsion device comprising a transom bracket adapted to be fixedly mounted on the transom of a boat, a propulsion unit mounted on said transom bracket for upward and downward pivotal movement relative thereto about a generally horizontal tilt axis, operator actuatable means for pivoting said propulsion unit about said tilt axis, said pivoting means including an extendable and contractable link connected between said transom bracket and said propulsion unit, and adjustable means operable independently of said operator actuatable means for stopping upward pivotal movement of said propulsion unit, said adjustable means including a first member fixed relative to said propulsion unit and a second member fixed relative to said link.

10. A marine propulsion device as set forth in claim 9 and further comprising a swivel bracket mounted on said transom bracket for pivotal movement relative thereto about said tilt axis, and wherein said propulsion unit is mounted on said swivel bracket for pivotal movement relative thereto about a generally vertical steering axis and for common movement therewith about said tilt axis.

11. A marine propulsion device as set forth in claim 9 wherein said pivoting means includes an extendable and contractable link connected between said transom bracket and said propulsion unit.

12. A marine propulsion device as set forth in claim 11 wherein said link includes a cylinder-piston assembly.

13. A marine propulsion device as set forth in claim 11 wherein said link has a first end pivotally connected to said transom bracket and a second end pivotally connected to said propulsion unit.

14. A marine propulsion device as set forth in claim 13 wherein said means stops pivotal movement of said propulsion unit when said link reaches a predetermined angle relative to said propulsion unit.

15. A marine propulsion device as set forth in claim 15 wherein said second end of said link is connected to said propulsion unit for pivotal movement relative thereto about a link axis, and wherein said second member is connected to said link for pivotal movement relative thereto about said link axis.

16. A marine propulsion device as set forth in claim 11 wherein the position of one of said first and second members is adjustable.

17. A marine propulsion device as set forth in claim 16 wherein the position of said second member relative to said link is adjustable.

18. A marine propulsion device as set forth in claim 17 and further comprising means for limiting movement of said second member relative to said link.

19. A marine propulsion device comprising a transom bracket adapted to be fixedly mounted on a transom of a boat, a propulsion unit mounted on said transom bracket for pivotal movement relative thereto about a generally horizontal tilt axis, pivoting means for causing pivotal movement of said propulsion unit about said tilt axis, and means including a first member fixed relative to one of said transom bracket and said propulsion unit and a second member fixed relative to said pivoting means for stopping pivotal movement of said propulsion unit in response to engagement of said first and second members.

20. A marine propulsion device as set forth in claim 19 wherein said stopping means stops upward pivotal movement of said propulsion unit.

21. A marine propulsion device as set forth in claim 19 wherein said pivoting means includes an extendable and contractable link connected between said transom bracket and said propulsion unit.

22. A marine propulsion device as set forth in claim 21 wherein said link has a first end pivotally connected to said transom bracket and a second end pivotally connected to said propulsion unit.

23. A marine propulsion device as set forth in claim 22 wherein said means stops pivotal movement of said propulsion unit when said link reaches a predetermined angle relative to said propulsion unit.

24. A marine propulsion device as set forth in claim 21 wherein said second member is mounted on said link.

25. A marine propulsion device as set forth in claim 19 and further comprising a swivel bracket mounted on said transom bracket for pivotal movement relative thereto about said tilt axis, wherein said propulsion unit is mounted on said swivel bracket for pivotal movement relative thereto about a generally vertical steering axis and for common movement therewith about said tilt axis, and wherein said first member is fixed relative to one of said transom bracket and said swivel bracket.

26. A marine propulsion device as set forth in claim 19 and further comprising means for adjusting the position of one of said first and second members.

27. A marine propulsion device as set forth in claim 26 wherein said adjusting means includes means for moving said second member pivotally relative to said pivoting means.

28. A marine propulsion device as set forth in claim 27 and further comprising means for limiting movement of said second member relative to said pivoting means.

29. A marine propulsion device as set forth in claim 27 wherein said pivoting means includes an extendable and contractable link having on end pivotally connected to said propulsion unit for pivotal movement relative thereto about a link axis, and wherein said second member is pivotable about said link axis.

30. A marine propulsion device as set forth in claim 19 wherein one of said first and second members is a switch and the other of said first and second members is a switch actuator.

31. A marine propulsion device comprising a transom bracket adapted to be fixedly mounted on the transom of a boat, a pivot member which is supported by said transom bracket and which extends along a generally horizontal tilt axis, a propulsion unit mounted on said pivot member for pivotal movement relative thereto about said tilt axis, means for pivoting said propulsion unit about said tilt axis, and means including a first member fixed relative to said propulsion unit, a second member fixed relative to said pivot member, and a third member adjustably fixed to said second member and engageable with said first member for stopping pivotal movement of said propulsion unit in response to engagement of said first and third members.

32. A marine propulsion device as set forth in claim 31 wherein said stopping means stops upward pivotal movement of said propulsion unit.

33. A marine propulsion device as set forth in claim 31 and further comprising a swivel bracket mounted on said pivot member for pivotal movement relative thereto about said tilt axis, wherein said propulsion unit is mounted on said swivel bracket for pivotal movement relative thereto about a generally vertical steering axis and for common movement therewith about said tilt axis, and wherein said first member is fixed relative to said swivel bracket.

34. A marine propulsion device as set forth in claim 31 wherein said third member is pivotally movable relative to said second member.

35. A marine propulsion device as set forth in claim 34 and further comprising means for limiting pivotal movement of said third member relative to said second member.

36. A marine propulsion device as set forth in claim 31 wherein said first member is a switch and said third member is a switch actuator.

37. A marine propulsion device as set forth in claim 31 wherein said third member is annular, surrounds said second member, and is selectively pivotable relative to said second member about said tilt axis.

38. A marine propulsion device as set forth in claim 37 wherein said second member has thereon a radially extending projection, and wherein said third member has therein a circumferentially extending slot receiving said projection and having opposite ends which engage said projection so as to limit pivotal movement of said third member relative to said second member.

39. A marine propulsion device as set forth in claim 38 wherein said third member has therethrough a set screw releasably engaging said second member to thereby releasably fix the position of said third member relative to said second member.

40. An outboard motor comprising a of a transom bracket adapted to be fixedly mounted on the transom boat, a swivel bracket mounted on said transom bracket for upward and downward pivotal movement relative thereto about a generally horizontal tilt axis, a propulsion unit mounted on said swivel bracket for pivotal movement relative thereto about a steering axis transverse to said tilt axis and for common movement therewith about said tilt axis, operator actuatable means for pivoting said swivel bracket about said tilt axis and including an extendable and contractable link pivotally connected to said swivel bracket about a second axis parallel to said tilt axis, a switch fixed on said swivel bracket and including a movable actuating button operable to open and close said switch, and an actuator which is angularly adjustable about one of said tilt and second axes and which is operably engageable with said button in response to tilting of said propulsion unit.

41. A marine propulsion device as set forth in claim 40 wherein said extendable and contractable link is connected between said transom bracket and said swivel bracket.

42. A marine propulsion device as set forth in claim 40 wherein said actuator is fixed relative to said transom bracket.

43. A marine propulsion device as set forth in claim 42 and further comprising a pivot member which is supported by said transom bracket and which extends along said tilt axis, wherein said swivel bracket is mounted on said pivot member for pivotal movement relative thereto about said tilt axis, and wherein said second member is fixed relative to said pivot member.

44. A marine propulsion device as set forth in claim 43 wherein the position of said second member relative to said pivot member is adjustable.

45. A marine propulsion device as set forth in claim 44 and further comprising means for limiting movement of said second member relative to said pivot member.

46. A marine propulsion device as set forth in claim 40 wherein said stopping means is adjustable such that said uppermost position is adjustable throughout a range of at least 30 degrees of pivotal movement of said swivel bracket about said tilt axis.

47. A marine propulsion device as set forth in claim 40 wherein said stopping means is adjustable such that said uppermost position is adjustable throughout a range of approximately 60 degrees of pivotal movement of said swivel bracket about said tilt axis.

48. An outboard motor comprising a transom bracket adapted to be fixedly mounted on the transom of a boat, a swivel bracket mounted on said transom bracket for upward and downward pivotal movement relative thereto about a generally horizontal tilt axis, a propulsion unit mounted on said swivel bracket for pivotal movement relative thereto about a steering axis transverse to said tilt axis and for common movement therewith about said tilt axis, operator actuatable means for pivoting said swivel bracket about said tilt axis and including an extendable and contractable link pivotally connected to said swivel bracket about a second axis parallel to said tilt axis, a switch fixed on said swivel bracket and including a movable actuating button operable to open and close said switch, and an actuator which is angularly adjustable about said tilt axis and which is operably engageable with said button in response to tilting of said propulsion unit so as to stoop upward pivotal movement of said swivel bracket beyond an uppermost position.

* * * * *